US009656371B2

(12) United States Patent
Sawada

(10) Patent No.: US 9,656,371 B2
(45) Date of Patent: May 23, 2017

(54) HIGH-HARDNESS ATOMIZED POWDER, POWDER FOR PROJECTING MATERIAL FOR SHOT PEENING, AND SHOT PEENING METHOD USING SAME

(75) Inventor: Toshiyuki Sawada, Himeji (JP)

(73) Assignee: Sanyo Special Steel Co., Ltd., Himeji-shi (JP)

( * ) Notice: Subject to any disclaimer, the term of this patent is extended or adjusted under 35 U.S.C. 154(b) by 458 days.

(21) Appl. No.: 14/006,796

(22) PCT Filed: Mar. 23, 2012

(86) PCT No.: PCT/JP2012/057546
§ 371 (c)(1),
(2), (4) Date: Dec. 5, 2013

(87) PCT Pub. No.: WO2012/128357
PCT Pub. Date: Sep. 27, 2012

(65) Prior Publication Data

US 2014/0090222 A1 Apr. 3, 2014

(30) Foreign Application Priority Data

Mar. 24, 2011 (JP) ..... 2011-065130

(51) Int. Cl.

| | |
|---|---|
| ***C22C 38/00*** | (2006.01) |
| ***B22F 9/08*** | (2006.01) |
| ***B24C 1/10*** | (2006.01) |
| ***B24C 11/00*** | (2006.01) |
| ***C22C 33/02*** | (2006.01) |

(52) U.S. Cl.
CPC ..... *B24C 1/10* (2013.01); *B22F 9/082* (2013.01); *B24C 11/00* (2013.01); *C22C 33/0257* (2013.01); *C22C 38/00* (2013.01); *Y10T 29/479* (2015.01); *Y10T 428/12014* (2015.01)

(58) Field of Classification Search
CPC ..... C22C 38/00; C22C 38/06; C22C 38/08; C22C 38/12; C22C 38/14; C22C 38/18; C22C 38/22; C22C 38/28; C22C 38/32; C22C 38/40; C22C 38/44; C22C 38/50;
(Continued)

(56) References Cited

FOREIGN PATENT DOCUMENTS

JP 200784858 A 4/2007

OTHER PUBLICATIONS

Sawada, Toshiyuki, and Akihiko Yanagitani. "Properties of Cold Work Tool Steel Shot Peened by 1200 HV-Class Fe—Cr—B Gas Atomized Power as Shot Peening Media." Materials Transactions 51.4 (2010): 735-39. Mar. 10, 2010. Web. Oct. 26, 2015.*

(Continued)

*Primary Examiner* — Jessee Roe
*Assistant Examiner* — Anthony Liang
(74) *Attorney, Agent, or Firm* — The Webb Law Firm

(57) ABSTRACT

There is disclosed a high-hardness atomized powder comprising in mass %: 2 to 8% of B; and one or two or more of Ti, Cr, Mo, W, Ni, Al, and C in an amount satisfying the following expression:

$$0 \leq (\text{Ti}\ \%/10)+(\text{Cr}\ \%/25)+(\text{Mo}\ \%/10)+(\text{W}\ \%/6)+(\text{Ni}\ \%/10)+(\text{Al}\ \%/10)+(\text{C}\ \%/1) \leq 1.00,$$

the balance being Fe and unavoidable impurities, and having a particle diameter of 75 μm or less. The powder, which has high hardness and is inexpensive, is particularly suitable for a powder for a projecting material for shot peening.

8 Claims, 1 Drawing Sheet

(58) Field of Classification Search
CPC ..... C22C 38/54; B24C 1/10; B21D 31/06; C21D 7/06; B22F 9/08
USPC ..... 75/255
See application file for complete search history.

(56) References Cited

OTHER PUBLICATIONS

Davis, J.R.. (2005). Gear Materials, Properties, and Manufacture—9.12 Shot Peening of Carburized and Hardened Gears. ASM International. 209.*
J.A. Jimenez, et al., Characterization of Rapidly Solidified Ultra-high Boron Steels, Materials Science and Engineering, vol. 159 No. 1, Dec. 15, 1992, pp. 103-109.

* cited by examiner

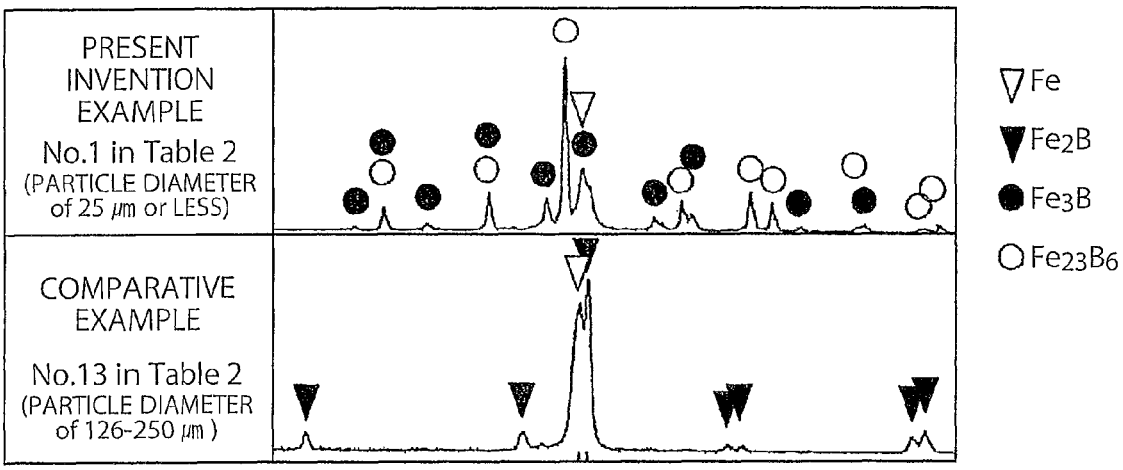
PRESENT INVENTION EXAMPLE
No.1 in Table 2
(PARTICLE DIAMETER of 25 μm or LESS)
COMPARATIVE EXAMPLE
No.13 in Table 2
(PARTICLE DIAMETER of 126-250 μm )
Fe
Fe2B
Fe3B
Fe23B6

HIGH-HARDNESS ATOMIZED POWDER, POWDER FOR PROJECTING MATERIAL FOR SHOT PEENING, AND SHOT PEENING METHOD USING SAME

CROSS-REFERENCE TO RELATED APPLICATION

This application claims priority to Japanese Patent Application No. 2011-65130 filed on Mar. 24, 2011, the entire content of which is incorporated herein by reference.

TECHNICAL FIELD

The present invention relates to a high-hardness atomized powder which has high hardness and is inexpensive, a powder for a projecting material for shot peening, and a shot peening method therewith.

BACKGROUND ART

In general, shot peening is an effective surface treatment method, in which particles referred to as a projecting material (or also referred to as "shot", "shot material", "medium", "abrasive material", or the like) are projected onto the surface of a material to be treated, compressive residual stress is applied, and fatigue strength can be improved, and is also applied to automobile components such as springs and gears, metal mold materials, or the like. As in the case of, e.g., gears subjected to carburizing and quenching treatment, the higher hardness of materials to be treated has been achieved, and also the higher hardness of projecting materials for these materials has been demanded. In other words, high compressive residual stress cannot be obtained by performing a shot peening in which a low-hardness projecting material is used for a high-surface-hardness material to be treated. Moreover, with the further need for reduction in the weight of an automobile component or the like, it is necessary to perform shot peening of a material to be treated which has increasingly high hardness and, therefore, there is a demand for a projecting material having further high hardness.

On the other hand, not only a projecting material having an average particle diameter of around 500 to 1000 μm used for standard shot peening, but also a projecting material having an average particle diameter of around 100 μm is used for fine-particle shot peening. The fine-particle shot peening does not excessively roughen the surface of a material to be projected, but allows large compressive residual stress to be applied to a portion closer to the treated surface, and greater improvement in fatigue strength than that in the case of standard shot peening is therefore expected. In recent years, use of a projecting material having a further small particle diameter has also been examined to make further use of the characteristics of the fine-particle shot peening.

The inventors have proposed, in Japanese Patent Laid-Open Publication No. 2007-84858 (Patent Literature 1), a projecting material that comprises a $Fe_2B$-based boride and an iron-base solid solution of BCC and/or FCC and contains 5 to 8% of B as an inexpensive projecting material with high hardness. One of the characteristics of the projecting material is in that the addition of 5% or more of B results in generation of a large amount of high-hardness $Fe_2B$, thereby increasing the hardness of the whole particles.

CITATION LIST

Patent Literature

[PTL 1] Japanese Patent Laid-Open Publication No. 2007-84858

SUMMARY OF THE INVENTION

The inventors have now found a phenomenon in which hardness increases with the reduction of a particle diameter in a Fe—B alloy-based projecting material having a predetermined composition.

It is therefore an object of the present invention to provide a high-hardness atomized powder which has high hardness and is inexpensive, a powder for a projecting material for shot peening, and a shot peening method therewith.

According to an embodiment of the present invention, there is provided a high-hardness atomized powder comprising in mass %:

2 to 8% of B; and one or two or more of Ti, Cr, Mo, W, Ni, Al, and C in an amount satisfying the following expression:

$$0 \leq (\text{Ti } \%/10)+(\text{Cr } \%/25)+(\text{Mo } \%/10)+(\text{W } \%/6)+(\text{Ni } \%/10)+(\text{Al } \%/10)+(\text{C } \%/1) \leq 1.00,$$

the balance being Fe and unavoidable impurities, and having a particle diameter of 75 μm or less.

According to another embodiment of the present invention, there is provided a powder for a projecting material for shot peening, comprising 30 mass % or more of the above-described high-hardness atomized powder having a particle diameter of 75 μm or less.

According to another embodiment of the present invention, there is provided a shot peening method comprising the step of projecting, as a projecting material, the above-described high-hardness atomized powder onto a surface of a material to be treated.

BRIEF DESCRIPTION OF THE DRAWING

FIG. 1 is a schematic view showing the X-ray diffraction patterns of projecting materials.

DESCRIPTION OF EMBODIMENTS

The present invention is specifically explained below. Unless otherwise specified, "%" as used herein means mass %.

The high-hardness atomized powder according to the present invention comprises in mass %: 2 to 8% of B; and one or two or more of Ti, Cr, Mo, W, Ni, Al, and C in an amount satisfying the following expression:

$$0 \leq (\text{Ti } \%/10)+(\text{Cr } \%/25)+(\text{Mo } \%/10)+(\text{W } \%/6)+(\text{Ni } \%/10)+(\text{Al } \%/10)+(\text{C } \%/1) \leq 1.00,$$

the balance being Fe and unavoidable impurities, preferably consists essentially of these elements and unavoidable impurities, and more preferably consists of these elements and unavoidable impurities. Moreover, the high-hardness atomized powder has a particle diameter of 75 μm or less.

Such characteristics of the present invention are based on the findings that the hardness of this alloy-based projecting material comprising 2 to 8% of B increases, when it becomes fine particles. In other words, large compressive residual stress can be applied to the surface of a material to be treated by using, for shot peening, a projecting material containing more than a given percentage of this projecting material. In particular, a large amount of a non-equilibrium boride, such as $Fe_3B$ or $Fe_{23}B_6$, which is not present in a Fe—B-based constitutional diagram is generated with the reduction of the particle diameter of the alloy-based projecting material of the present invention, resulting in a great increase in hardness. As described above, the atomized powder of the present invention is based on the findings of a phenomenon in which hardness greatly increases not due to a mere refinement of a structure, but due to the change of a constituent phase to a non-equilibrium phase.

The atomized powder according to the present invention comprises 2 to 8%, preferably 2 to 7%, more preferably 3 to 5%, of B. In the alloy of the present invention, B is an essential element for generating $Fe_2B$, which is an equilibrium phase, and also for generating a non-equilibrium phase such as $Fe_3B$ or $Fe_{23}B_6$ with the reduction of a particle diameter to increase hardness. A content of B of less than 2% results in less effect of increasing hardness with the reduction of the particle diameter, while a content of B of more than 8% results in the significant embrittlement of particles. Further, increase in the amount of added B proceeds increase in hardness and embrittlement simultaneously at the same particle size, and thus B is made to be in the above-described range.

The atomized powder according to the present invention has a particle diameter of 75 μm or less, preferably 45 μm or less, more preferably 25 μm or less. In this alloy-based projecting material, the hardness increases as the particle diameter reduces, but a great increase in hardness cannot be observed when the particle size is larger than 75 μm.

The atomized powder according to the present invention may optionally comprise, as optional elements, one or two or more of Ti, Cr, Mo, W, Ni, Al, and C in an amount satisfying the following expression:

$$0<(Ti\ \%/10)+(Cr\ \%/25)+(Mo\ \%/10)+(W\ \%/6)+(Ni\ \%/10)+(Al\ \%/10)+(C\ \%/1)\leq 1.00,$$

In this alloy-based projecting material, Ti, Mo, W, and C are additional elements effective in increasing the hardness, while Cr, Ni, and Al are additive elements effective in improving corrosion resistance, and each of the elements can be added as needed. However, particles are significantly embrittled, if these elements are added in the amount of (Ti %/10)+(Cr %/25)+(Mo %/10)+(W %/6)+(Ni %/10)+(Al %/10)+(C %/1) of more than 1.00.

Although these additive elements are effective in increasing hardness and in improving corrosion resistance, the excessive addition of each of the elements results in embrittlement. The limit of the addition amount before causing significant embrittlement varies depending on the kind of each element and the limits of Ti, Cr, Mo, W, Ni, Al, and C are 10%, 25%, 10%, 6%, 10%, 10%, and 1%, respectively. Accordingly, in the case of the multiple additions thereof, the elements can be added in the ranges in which the amounts of the respective elements added are standardized at the concentrations of their limits and the total value of the amounts does not exceed 1.

Since, in fact, these additive elements are optional elements, the atomized powder according to the present invention may be substantially free of Ti, Cr, Mo, W, Ni, Al, and C.

The powder for a projecting material for shot peening according to the present invention comprises 30 mass % or more, preferably 50 mass % or more, more preferably 70 mass % or more, of the above-mentioned high-hardness atomized powder of 75 μm or less. In other words, particles of 75 μm or less have a large effect of increasing hardness, and large compressive residual stress is obtained by using, as a projecting material, particles comprising 30 mass % or more, preferably 50 mass % or more, more preferably 70 mass % or more, of the particles (i.e., by projecting the particles as a projecting material onto the surface of a material to be treated).

According to the findings of the inventors, hardness varies depending on a particle diameter even in a projecting material having the same composition. The reason can be understood, for example, from the X-ray diffraction patterns of the projecting materials shown in FIG. 1. In other words, the X-ray diffraction patterns of the projecting materials No. 1 (particle diameter of 25 μm or less) in Table 2 as a present invention example and No. 13 (particle diameter of 126 to 250 μm) in Table 2 as a comparative example in FIG. 1 show that a constituent phase is changed by varying a particle diameter. In this manner, the constituent phase of this alloy-based projecting material is significantly changed depending on its particle diameter even in the same composition. It is supposed that the hardness change depending on the particle diameter is caused by such change of the constituent phase.

EXAMPLES

The present invention is specifically explained below with reference to Examples.

For sample powders shown in Tables 1 to 4, raw materials weighed to have predetermined compositions were induction-molten in argon atmosphere in a crucible made of a refractory material, and tapped from a tapping nozzle in the bottom of the crucible to produce the powders by gas atomization. The resultant powders were classified into 25 μm or less, 26 to 45 μm, 46 to 75 μm, 76 to 125 μm, and 126 to 250 μm, embedded into a resin, and polished to obtain samples, and the hardness of each of the samples was measured at a load of 25 g by a micro Vickers hardness tester. In this case, the hardness of each powder having each composition in each particle diameter was evaluated as relative hardness based on the hardness of the particles of 126 to 250 μm as 100 to evaluate the increase in hardness with the reduction in the particle diameter.

The reason for the evaluation according to a component as described above is that hardness varies depending on the component. In other words, since both the influence of the component and the influence of a particle diameter correlating with the constituent phase of a powder coexist, the influence of the particle diameter correlating with the constituent phase of the powder cannot be purely evaluated, and thus the effect of the present invention cannot be shown clearly. In accordance with the present invention, the case of a particle size at which a relative hardness was 110 or more was considered to have the effect with the reduction of the particle size and was regarded as a present invention example.

As for brittleness, each of the above-mentioned samples embedded into the resin was provided with five indentations at a load of 300 g by the micro Vickers hardness tester, and a case in which none of the five indentations was cracked was evaluated as "good," while a case in which any one or more thereof were cracked was judged to be brittle and was evaluated as "poor." Further, as for corrosion resistance, each of the powders having the compositions, shown in Table 3, classified into 46 to 75 μm was spreaded over a double-faced tape stuck on a glass plate and was subjected to a humidity cabinet test under conditions of a temperature of 70° C., a humidity of 95% and 96 hours to evaluate the influence of the additive elements on corrosion resistance. The case of being rusted on the whole surface was evaluated as "fair," while the case of being only partially rusted was evaluated as "good."

For evaluation of shot peening, an SCM420 base material was hot-forged to have a diameter of 12 mm and was cut to have a length of 100 mm to obtain a test piece, which was cut to have a diameter of 10 mm by turning process. The resultant was subjected to gas carburizing and hardening and tempering treatment to make a material to be treated for shot peening. The material to be treated has a surface hardness of 700 to 800 HV and an effective case depth of approximately 1 mm. By means of an air-type shot peening apparatus, projection onto the material to be treated was carried out at a projection pressure of 0.3 MPa for 30 seconds. Compressive residual stress was measured by an X-ray diffraction method every time the treated surface of each treated test piece was electrolytically polished by 5 μm up to 40 μm in depth. In the method, the highest compressive residual stress value was regarded as the maximum compressive residual stress. In all the test pieces, the maximum compressive residual stress values were observed in the sites 40 μm or less from the surfaces.

The projecting materials having particle sizes of 25 μm or less, 26 to 45 μm, 46 to 75 μm, 76 to 125 μm, and 126 to 250 μm were mixed at percentages shown in Table 4 and were used. As for evaluation, the maximum compressive residual stress value of each projecting material having each composition, in which 100% thereof has a diameter of 76 to 125 μm, was set to 100, and the maximum compressive residual stress value of a mixture of materials having any of other particle diameters at a predetermined percentage was evaluated as a relative value. The reason for the evaluation according to a component is that the maximum compressive residual stress value varies depending on the component. In other words, this is because, when the influence of a component and the influence of a particle diameter correlating with the constituent phase of a powder coexist, the influence of the particle diameter correlating with the constituent phase of the powder cannot be purely evaluated and, therefore, the effect of the present invention cannot be shown clearly. In accordance with the present invention, the case of a particle size at which the relative value of the maximum compressive residual stress value was 107 or more was considered to have the effect with the reduction of the particle size and was regarded as a present invention example.

TABLE 1

| | Composition (mass %) | | | Particle | | | |
|---|---|---|---|---|---|---|---|
| No. | B | Fe | Value of Expression | Diameter (μm) | Relative Hardness | Brittleness | |
| 1 | 2 | Balance | 0 | ≤25 | 128 | Good | Present |
| 2 | 2 | Balance | 0 | 26-45 | 119 | Good | Invention |
| 3 | 2 | Balance | 0 | 46-75 | 115 | Good | Examples |
| 4 | 4 | Balance | 0 | ≤25 | 121 | Good | |
| 5 | 4 | Balance | 0 | 26-45 | 112 | Good | |
| 6 | 4 | Balance | 0 | 46-75 | 110 | Good | |
| 7 | 6 | Balance | 0 | ≤25 | 118 | Good | |
| 8 | 6 | Balance | 0 | 26-45 | 115 | Good | |
| 9 | 6 | Balance | 0 | 46-75 | 111 | Good | |
| 10 | 8 | Balance | 0 | ≤25 | 116 | Good | |
| 11 | 8 | Balance | 0 | 26-45 | 113 | Good | |
| 12 | 8 | Balance | 0 | 46-75 | 110 | Good | |
| 13 | 1 | Balance | 0 | ≤25 | 105 | Good | Comparative |
| 14 | 1 | Balance | 0 | 26-45 | 104 | Good | Examples |
| 15 | 1 | Balance | 0 | 46-75 | 102 | Good | |
| 16 | 1 | Balance | 0 | 76-125 | 104 | Good | |
| 17 | 1 | Balance | 0 | 126-250 | 100 | Good | |
| 18 | 2 | Balance | 0 | 76-125 | 104 | Good | |
| 19 | 2 | Balance | 0 | 126-250 | 100 | Good | |
| 20 | 4 | Balance | 0 | 76-125 | 103 | Good | |
| 21 | 4 | Balance | 0 | 126-250 | 100 | Good | |
| 22 | 6 | Balance | 0 | 76-125 | 101 | Good | |
| 23 | 6 | Balance | 0 | 126-250 | 100 | Good | |
| 24 | 8 | Balance | 0 | 76-125 | 100 | Good | |
| 25 | 8 | Balance | 0 | 126-250 | 100 | Good | |
| 26 | 10 | Balance | 0 | ≤25 | 115 | Poor | |
| 27 | 10 | Balance | 0 | 26-45 | 113 | Poor | |
| 28 | 10 | Balance | 0 | 46-75 | 110 | Poor | |
| 29 | 10 | Balance | 0 | 76-125 | 103 | Poor | |
| 30 | 10 | Balance | 0 | 126-250 | 100 | Poor | |

NOTE:
The underlined figures fall outside the scope of the present invention.
NOTE 2:
Expression: (Ti %/10) + (Cr %/25) + (Mo %/10) + (W %/6) + (Ni/10) + (Al %/10) + (C %/1)

In Table 1, which shows the influence of a particle diameter on the hardness of a Fe—B-based projecting material, Nos. 1 to 12 are present invention examples, while Nos. 13 to 30 are comparative examples.

Comparative Examples Nos. 13 to 17 shown in Table 1 result in the insufficient effect of increasing hardness with the reduction of a particle diameter, because B is as low as 1% and Nos. 16 to 17 also result in the insufficient effect of increasing hardness with the reduction of the particle diameter due to the large particle diameter of 76 μm or more. Comparative Examples Nos. 18 to 25 result in the insufficient effect of increasing hardness with the reduction of the particle diameter because the particle diameter of each thereof is 76 μm or more. Comparative Examples Nos. 26 to 30 result in significant embrittlement, because B is as high as 10%. In contrast, Present Invention Examples Nos. 1 to 12 all satisfy B in the composition and a particle diameter which are the requirements of the present invention and thus found to be able to provide sufficient performance on hardness and brittleness.

TABLE 2

| No. | Composition (mass %) B | Other Elements | Fe | Value of Expression | Particle Diameter (μm) | Relative Hardness | Brittleness | |
|---|---|---|---|---|---|---|---|---|
| 1 | 4 | 8Cr | Balance | 0.32 | ≤25 | 135 | Good | Present |
| 2 | 4 | 8Cr | Balance | 0.32 | 26-45 | 123 | Good | Invention |
| 3 | 4 | 8Cr | Balance | 0.32 | 46-75 | 118 | Good | Examples |
| 4 | 2 | 1C | Balance | 1.00 | 46-75 | 117 | Good | |
| 5 | 4 | 5Ti | Balance | 0.50 | 46-75 | 111 | Good | |
| 6 | 6 | 4W | Balance | 0.67 | 46-75 | 112 | Good | |
| 7 | 8 | 10Ni | Balance | 1.00 | 46-75 | 113 | Good | |
| 8 | 6 | 5Al | Balance | 0.50 | 46-75 | 110 | Good | |
| 9 | 4 | 3Mo | Balance | 0.30 | 46-75 | 119 | Good | |
| 10 | 4 | 5Cr2Ni0.5C | Balance | 0.90 | 46-75 | 120 | Good | |
| 11 | 6 | 1Ti2Cr1Mo1W4Ni1Al | Balance | 0.95 | 46-75 | 110 | Good | |
| 12 | 4 | 8Cr | Balance | 0.32 | 76-115 | 105 | Good | Comparative |
| 13 | 4 | 8Cr | Balance | 0.32 | 126-250 | 100 | Good | Examples |
| 14 | 4 | 1C | Balance | 1.00 | 126-250 | 100 | Good | |
| 15 | 4 | 5Ti | Balance | 0.50 | 126-250 | 100 | Good | |
| 16 | 6 | 4W | Balance | 0.67 | 126-250 | 100 | Good | |
| 17 | 8 | 10Ni | Balance | 1.00 | 126-250 | 100 | Good | |
| 18 | 6 | 5Al | Balance | 0.50 | 126-250 | 100 | Good | |
| 19 | 4 | 3Mo | Balance | 0.30 | 126-250 | 100 | Good | |
| 20 | 4 | 5Cr2Ni0.5C | Balance | 0.90 | 126-250 | 100 | Good | |
| 21 | 6 | 1Ti2Cr1Mo1W4Ni1Al | Balance | 0.95 | 126-250 | 100 | Good | |
| 22 | 4 | 26Cr | Balance | 1.04 | 46-75 | 112 | Poor | |
| 23 | 2 | 1.5C | Balance | 1.50 | 46-75 | 121 | Poor | |
| 24 | 4 | 12Ti | Balance | 1.20 | 46-75 | 118 | Poor | |
| 25 | 6 | 12W | Balance | 2.00 | 46-75 | 113 | Poor | |
| 26 | 8 | 15Ni | Balance | 1.50 | 46-75 | 113 | Poor | |
| 27 | 6 | 12Al | Balance | 1.20 | 46-75 | 113 | Poor | |
| 28 | 4 | 18Mo | Balance | 1.80 | 46-75 | 116 | Poor | |
| 29 | 4 | 6Cr3Ni0.6C | Balance | 1.14 | 46-75 | 111 | Poor | |
| 30 | 6 | 2Ti3Cr2Mo2W5Ni2Al | Balance | 1.55 | 46-75 | 112 | Poor | |

NOTE 1:

The underlined figures fall outside the scope of the present invention.

NOTE 2:

Expression: (Ti %/10) + (Cr %/25) + (Mo %/10) + (W %/6) + (Ni/10) + (Al %/10) + (C %/1)

In Table 2, which shows the influence of a particle diameter on hardness and brittleness of a projecting material in which other elements were added to a Fe—B-based material, Nos. 1 to 11 are present invention examples, while Nos. 12 to 30 are comparative examples.

Comparative Examples Nos. 12 to 13 result in the insufficient effect of increasing hardness with the reduction of the particle diameter, as the particle diameter is 76 μm or more. Comparative Examples Nos. 14 to 21 also result in the insufficient effect of increasing hardness with the reduction of the particle diameter, as the particle diameter is 76 μm or more. Comparative Examples Nos. 22 to 30 all result in significant embrittlement due to a value of the expression of more than 1.

TABLE 3

| No. | Composition (mass %) B | Other Elements | Fe | Value of Expression | Particle Diameter (μm) | Corrosion Resistance | |
|---|---|---|---|---|---|---|---|
| 1 | 4 | — | Balance | 0 | 46-75 | Fair | Present |
| 2 | 4 | 8Cr | Balance | 0.32 | 46-75 | Good | Invention |
| 3 | 8 | — | Balance | 0 | 46-75 | Fair | Examples |
| 4 | 8 | 10Ni | Balance | 1.00 | 46-75 | Good | |
| 5 | 6 | — | Balance | 0 | 46-75 | Fair | |
| 6 | 6 | 5Al | Balance | 0.50 | 46-75 | Good | |

Table 3 shows the influence of the additional elements on corrosion resistance.

As shown in this Table 3, Nos. 1, 3, and 5 comprising Fe—B two-element-based materials result in rust on the whole surface by a corrosion test, while Nos. 2, 4, and 6, to which Cr, Ni, and Al were added, respectively, result in partial rust and improvement in corrosion resistance. In other words, it is found that corrosion resistance is improved when Cr, Ni, or Al is added to a Fe—B-based material.

TABLE 4

| | Projecting Material Component (%) | | | Mixing Ratio (%) of Projecting Materials | | | | | Maximum Compressive Residual Stress | |
|---|---|---|---|---|---|---|---|---|---|---|
| No. | B | Fe | Other Elements | ≤25 μm | 26-45 μm | 46-75 μm | 76-125 μm | 126-250 μm | (Relative Value) | |
| 1 | 4 | Balance | — | 0 | 0 | 100 | 0 | 0 | 117 | Present |
| 2 | 4 | Balance | — | 0 | 100 | 0 | 0 | 0 | 117 | Invention |
| 3 | 4 | Balance | — | 100 | 0 | 0 | 0 | 0 | 115 | Examples |
| 4 | 4 | Balance | — | 0 | 0 | 70 | 30 | 0 | 115 | |
| 5 | 4 | Balance | — | 0 | 50 | 0 | 50 | 0 | 112 | |
| 6 | 4 | Balance | — | 30 | 0 | 0 | 70 | 0 | 109 | |
| 7 | 4 | Balance | — | 0 | 40 | 30 | 30 | 0 | 116 | |
| 8 | 4 | Balance | — | 10 | 40 | 40 | 10 | 0 | 119 | |
| 9 | 8 | Balance | | 0 | 0 | 30 | 70 | 0 | 107 | |
| 10 | 6 | Balance | 4W | 0 | 0 | 30 | 70 | 0 | 110 | |
| 11 | 4 | Balance | 5Cr2Ni0.5C | 0 | 50 | 0 | 50 | 0 | 114 | |
| 12 | 4 | Balance | — | 0 | 0 | 0 | 0 | 100 | 102 | Comparative |
| 13 | 4 | Balance | — | 0 | 0 | 0 | 100 | 0 | 100 | Examples |
| 14 | 4 | Balance | — | 0 | 0 | 10 | 90 | 0 | 103 | |
| 15 | 4 | Balance | — | 10 | 0 | 0 | 90 | 0 | 100 | |
| 16 | 8 | Balance | — | 0 | 0 | 0 | 100 | 0 | 100 | |
| 17 | 6 | Balance | 4W | 0 | 0 | 0 | 100 | 0 | 100 | |
| 18 | 4 | Balance | 5Cr2Ni0.5C | 0 | 0 | 0 | 100 | 0 | 100 | |

Table 4 shows the influence of the particle size of a projecting material on the maximum compressive residual stress value applied by shot peening.

As shown in this Table 4, the influence of the mixing ratio of projecting materials on the maximum compressive residual stress value is shown. In Nos. 1 to 11, which are present invention examples, the mixing ratio of the projecting material having a particle diameter of 75 μm or less is 30% or more. Comparative Examples Nos. 12 to 18 result in insufficient maximum compressive residual stress values because of containing approximately nearly 100% of a material having a particle diameter of 76 μm or more.

Further, the measurement of the surface roughness (arithmetic mean roughness Ra) of the test pieces after subjected to shot peening in Nos. 1 to 3, which are present invention examples in which the influence of a particle diameter was simply examined and Comparative Examples 12 and 13 result in the order of No. 3<No. 2<No. 1<No. 13<No. 12. It is therefore found that increase in the surface roughness of a material to be treated is suppressed by reducing the particle diameter of a projecting material as described in the background.

As described above, in this alloy-based projecting material, a non-equilibrium boride which is not seen in a constitutional diagram is found to be significantly generated with the reduction of a particle size, not merely by making a microstructure finer, and the very superior effect of providing an excellent projecting material with hardness increased with the reduction of the particle size by this change of a constituent phase is shown.

The invention claimed is:

1. A projecting material for shot peening, comprising 50 mass % or more of a high-hardness atomized powder, the high-hardness atomized powder comprising in mass %:

2 to 8% of B; and one or two or more of Ti, Cr, Mo, W, Ni, Al, and C in an amount satisfying the following expression:

$$0 \leq (Ti\ \%/10)+(Cr\ \%/25)+(Mo\ \%/10)+(W\ \%/6)+(Ni\ \%/10)+(Al\ \%/10)+(C\ \%/1) \leq 1.00,$$

the balance being Fe and unavoidable impurities, wherein the high-hardness atomized powder has a particle diameter of 75 μm or less and comprises a non-equilibrium boride phase that is not present in an Fe—B phase diagram.

2. The projecting material for shot peening according to claim 1, wherein the high-hardness atomized powder consists of:

2 to 8% of B; and one or two or more of Ti, Cr, Mo, W, Ni, Al, and C in an amount satisfying the following expression:

$$0 \leq (Ti\ \%/10)+(Cr\ \%/25)+(Mo\ \%/10)+(W\ \%/6)+(Ni\ \%/10)+(Al\ \%/10)+(C\ \%/1) \leq 1.00,$$

the balance being Fe and unavoidable impurities.

3. The projecting material for shot peening according to claim 1, wherein the high-hardness atomized powder is substantially free of Ti, Cr, Mo, W, Ni, Al, and C.

4. The projecting material for shot peening according to claim 2, wherein the high-hardness atomized powder is substantially free of Ti, Cr, Mo, W, Ni, Al, and C.

5. The projecting material for shot peening according to claim 1, wherein the high-hardness atomized powder comprises one or two or more of Ti, Cr, Mo, W, Ni, Al, and C in an amount satisfying the following expression:

$$0 < (Ti\ \%/10)+(Cr\ \%/25)+(Mo\ \%/10)+(W\ \%/6)+(Ni\ \%/10)+(Al\ \%/10)+(C\ \%/1) \leq 1.00.$$

6. The projecting material for shot peening according to claim 2, wherein the high-hardness atomized powder comprises one or two or more of Ti, Cr, Mo, W, Ni, Al, and C in an amount satisfying the following expression:

$$0 < (Ti\ \%/10)+(Cr\ \%/25)+(Mo\ \%/10)+(W\ \%/6)+(Ni\ \%/10)+(Al\ \%/10)+(C\ \%/1) \leq 1.00.$$

7. A shot peening method comprising the step of projecting the projecting material according to claim 1 onto a surface of a material to be treated.

8. The projecting material for shot peening according to claim 1, wherein the non-equilibrium boride phase is $Fe_3B$ or $Fe_{23}B_6$.

* * * * *